US005462774A

United States Patent [19]

Huvey et al.

[11] Patent Number: 5,462,774

[45] Date of Patent: Oct. 31, 1995

[54] LASER ENGRAVING TO FORM PRINTING SURFACES

[75] Inventors: Michel Huvey, Bougival; François Grosjean, Versailles; Lucien Montabord, Cormeilles en Parisis, all of France

[73] Assignee: Institut Francais du Petrole, Rueil Malmaison, France

[21] Appl. No.: 115,076

[22] Filed: Sep. 2, 1993

[51] Int. Cl.[6] ..... B05D 3/00

[52] U.S. Cl. ..... 427/555; 427/271; 427/385.5

[58] Field of Search ..... 427/555, 271, 427/385.5

[56] References Cited

U.S. PATENT DOCUMENTS

| | | | |
|---|---|---|---|
| 1,377,509 | 5/1921 | Novotny | 101/395 |
| 1,377,519 | 5/1921 | Novotny | 101/395 |
| 3,267,308 | 8/1966 | Geffrede | 101/395 |
| 4,007,680 | 2/1977 | Pfleger et al. | 101/153 |
| 4,275,142 | 6/1981 | Hasaka et al. | 430/271 |
| 4,526,649 | 7/1985 | Gupto et al. | 156/629 |
| 4,757,117 | 7/1988 | Moss | 525/483 |
| 5,332,650 | 7/1994 | Murata et al. | 430/270 |

FOREIGN PATENT DOCUMENTS

| | | | |
|---|---|---|---|
| 0094142 | 11/1983 | European Pat. Off. | B41M 1/12 |
| 0176475 | 4/1986 | European Pat. Off. | B41N 1/12 |
| 0440079 | 8/1991 | European Pat. Off. | G03F 7/18 |
| 2323169 | 4/1977 | France | G03C 1/68 |
| 3109096 | 12/1981 | Germany | B41C 1/04 |
| 63-284545 | 11/1988 | Japan | G03C 1/71 |
| 2125259 | 5/1990 | Japan | G03F 7/012 |
| 2071011 | 9/1981 | United Kingdom | B41N 1/12 |

*Primary Examiner*—Benjamin Utech

*Attorney, Agent, or Firm*—Millen, White, Zelano & Branigan

[57] ABSTRACT

Described are engravable coating compositions, in particular for printing cylinders, which comprise at least one resin capable of undergoing coking and producing only a very small proportion of products which are liquid at the temperature at which it decomposes, the main products of decomposition thereof being solid or gaseous at that temperature;

and in general a reinforcing particulate filler having a small proportion of edges having acute projecting angles, said filler generally representing a proportion of from 5 to 75% of the resin+filler volume.

The process for coating the cylinders comprises:

mixing the resin and the filler and degassing the mixture produced;

the coating operation in the true sense and drying the layer or successive layers deposited; and baking the coating.

11 Claims, No Drawings

LASER ENGRAVING TO FORM PRINTING SURFACES

BACKGROUND OF THE INVENTION

The present invention concerns coating compositions, in particular for making engravable surfaces and more particularly for the production of printing cylinders which are engravable by direct laser engraving. It also concerns the production of such cylinders.

The cylinders used in photogravure are generally used for printing packaging materials, wall and floor coverings, magazines, advertising inserts and mail-order catalogues, either for printing operations involving a long run or for printing on non-absorbent carriers.

A photoengravable cylinder is generally constituted as described hereinafter:

Taking a cylindrical steel structure, deposited thereon is a layer of copper (by reaction of copper sulphate) with a nickel bonding flash. The copper layer is trued and then engraved or etched with blind holes referred to as cells or cavities, the distribution and the dimensions of which define the printed surfaces and the tonality thereof. After engraving, the cylinder is chromium-plated to present a surface which is resistant to abrasion and which can be wiped off with the doctor blade. The chromium-plated cylinder is then polished to remove the roughness of the chromium.

The cylinder is generally used on a rotary press, in the following fashion:

a) inking: the cylinder rotates in liquid ink and a doctor blade of steel wipes the surface to leave ink only in the cells or cavities;

b) printing: the printing carrier comes into contact with the cylinder, under pressure. The ink is transferred from the cell or cavity of the cylinder to the carrier which becomes inked; and c) drying: the ink used generally being a solution of a resin in a volatile solvent holding pigments in suspension, the solvent is evaporated by the action of a flow of hot air and the ink solidifies in the form of a film.

The above-described cycle is that of a cylinder for printing a single color; that cylinder is disposed in a printing unit. To produce polychromatic printing, it is necessary to use a plurality of cylinders in line, up to twelve for rotary presses having twelve units.

The main advantages of photogravure are known.

Photogravure makes it possible to print on all materials: paper, cardboard, plastic films, metals etc, by virtue of its drying system. It makes it possible to print on continuous strips which are interrupted only by stopping the machine. In fact, at the end of a reel, it is possible to connect the strip of the following reel, without stopping the machine.

In addition photogravure is a multi-format printing process: it is only necessary to change the format (diameter) of the cylinder without any other adaptation.

In addition, compared with other printing processes, photogravure comprises the minimum amount of moving mechanical parts. Apart from the movement of the doctor blade, all the movements involved are rotary movements.

Moreover the capacity for transferring a great deal of ink permits deep flat tints while the transparency of the inks makes it possible to reproduce tonalities of very many colors.

Finally, from the point of view of economy, the cost of the inks and the ratio of machine capital investment and productivity of the equipment make it possible to produce high-quality printing at a very low cost price.

However the present procedure for engraving copper-plated, nickel-plated and chromium-plated steel cylinders causes pollution because of the use of electrolysis baths on the one hand and because of the solvent,bearing inks which take well to the chromium-plated cylinders, on the other hand. Water inks are potentially less polluting but they do not take well to the chromium-plated cylinders.

Morever the steel printing cylinders are between heavy and very heavy and the use thereof requires substantial handling means.

The ink is dried by evaporation of the solvents of the ink. As of 1993, in some countries including France, such solvents can no longer be discharged to the atmosphere and will have to be destroyed by incineration or otherwise absorbed over activated carbon and distilled, and that will necessitate additional capital investment and increased operating costs.

It is possible to think of replacing the solvents of the ink with water. However the surface tension of the chromium of the cylinder is unfavorable in regard to the use of water-bearing inks. Moreover a photoengravable cylinder is a precision tool both in regard to its geometrical characteristics and in regard to its surface condition but in particular in its printing surface which is made up of cells or cavities measuring from 10 microns to 150 microns spaced sometimes at 10 microns. The depth of the cells or cavities is also important in regard to regulating the ink flow rates. A tolerance of 2.5 microns, which is accepted at the present time, gives visible effects. That level of precision is applied to components which are from 370 to 3000 mm in length and from 60 to 500 nm in diameter.

Modern photogravure processes treat the images in infography (information graphics) with a degree of precision of 1 micron, handling 16 million colors, but transfer the image on to the cylinder either with photoresists or by mechanical engraving or etching and thus lose the degree of precision in terms of information.

Laser engraving makes it possible to transmit that precision in respect of information and to render the process viable.

When using procedures which make it possible to produce cavities or 'engraving bridges' (the distance between two cavities) of 10 microns, it seems absurd to produce chromium coatings of 8 microns which modify the size of the cavities and the engraving bridges.

An object which is as demanding as a photoengravable cylinder uses expensive procedures which are much more expensive than those required for the flexographic, screen or offset printing forms.

In spite of the items of infographic equipment, the cost of which is the same irrespective of the process, a photoengraved cylinder is ten times more expensive than an offset plate.

To reduce the cost of the cylinder cycle to that of its main competitor, namely offset printing, it would be necessary to change the present day technologies some of which date from 150 years ago. The technologies involved in copper plating and chromium plating have scarcely changed.

The electrolytic deposit of heavy metals gives rise to gaseous wastes and waste waters which have to be treated before being discarded.

The presence of volumes of baths which are proportional to the dimension of the parts to be treated involves industrial risks which mean that that activity is included among the classified industries.

Doing away with metal coatings and replacing them by a single synthetic coating would make it possible to eliminate the copper plating and chromium plating operations and thus to eliminate treatment of the waste waters, which at the present time represents a substantial operating cost.

SUMMARY OF THE INVENTION

In general the aim of the present invention is to retain the advantages of photoengraving while eliminating the disadvantages thereof, by using a non-metallic coating layer which is directly engravable by means of a laser and which takes water-bearing inks well.

With such an aim in mind, the use has already been proposed of compositions based on resins which are easy to destroy by a thermal procedure such as epoxy resins which are more or less filled with pigments in order satisfactorily to absorb the laser radiation and/or fillers causing the formation of gas intended to dispel the material which is burnt by the laser impact. However those compositions are not satisfactory as there is formed at the opening of the hole which is hollowed out, a dejection cone which is several microns in height of partially decomposed material, which is capable of partially re-blocking the hollowed-out hole, in a subsequent polishing operation or under the effect of the doctor blade.

The compositions of the present invention do not suffer from the above-mentioned disadvantages.

Based on resins which have a high level of thermal resistance, they undergo coking instead of melting and under the laser impact give holes with very clean edges which moreover take the water-bearing inks well.

The invention therefore provides a process for engraving a surface for printing, characterized by engraving by means of a laser beam a coating resulting from the hardening of a composition comprising at least one resin capable of undergoing coking and producing only a very shall proportion of products which are liquid at the temperature at which it decomposes, the main products of the decomposition thereof being solid or gaseous at that temperature, and optionally a filler formed by particles of elevated hardness, said filler being in the form of particles of very small granulometry, which preferably have a small proportion of acute projecting angles.

Among the resins which are capable of coking under the action of very high temperatures, mention will be made primarily of the resins resulting from the condensation of formaldehyde on fururyl alcohol, furfural, melamine, a phenol or urea (generically referred to as formaldehyde resins) or a resin resulting from the reaction of fururyl alcohol or furural with formaldehyde, urea, a phenol or itself (generically referred to as furan resins).

It will be noted that the resins resulting from the action of formaldehyde on furfuryl alcohol or furfural belong to both groups at the same time.

More particularly the resin may be selected from melamine formaldehyde resins, phenol formaldehyde resins such as resols and furan resins.

The reinforcing filler used in the coating compositions according to the invention to improve the resistance thereof to wear may more especially consist of micro-particles of glass, silica in the form of micro-fine dust, zirconium oxide, carborundum, alumina or carbon such as fullerenes.

The particles constituting the filler may be of dimensions which are preferably smaller by an order of magnitude than those of the holes which are to be subsequently produced by laser impact and more particularly smaller than about ten microns.

The proportion of particulate fillers used is generally from 5 to 75% by volume with respect to the total resin+fillers volume.

As will be described hereinafter the coating may comprise a first coating formed by one of the hardened filled resins described above and a fine layer of hardened non-filled resin, primarily formed by melanine-formaldehyde resin.

Described hereinafter is the process for coating a cylindrical surface, in particular a printing cylinder which can be laser-engraved, by means of a coating composition according to the invention.

In general that process comprises:

(a) a step for preparation of the coating composition including a mixing operation and an operation of degassing the mixture produced;

(b) the coating step in the true sense; and (c) a step for baking the material.

In the step for preparation of the coating composition, a mixture is made from at least one resin and at least one particulate filler, as have been defined hereinbefore, in suitable proportions. Thus the particulate filler may be used in a proportion ranging from 5 to 75% of the total resin+filler volume, the resin being counted only in respect of its dry extract when it is used in the form of solution.

The mixing operation can be effected in a diluent or a solvent such as for example water or aliphatic alcohol, in particular ethanol.

Dilution has the advantage of permitting a high proportion of filler in the finished product, while permitting easy degassing. In some cases it may necessitate an evaporation phase upon being applied to the cylinder.

The mixture formed in that way is then put under reduced pressure in such a fashion as to eliminate at least in part the gases contained in the filler, a part of the gases dissolved in the resin and the major part of the air introduced in the mixing operation.

The gases contained in the mixture are then expanded and a foam is formed, the volume of which can attain more than ten times the initial volume of the mixture. That foam 'breaks' with liberation of the gases which are thus given off and the operation can be repeated one or more times until foam is no longer formed, but gentle boiling of the solvent or the diluent is observed. It can then be considered that there is practically no longer any gas dissolved in the composition and the degassing is sufficient.

In step (b) for coating the cylinder the procedure involved can be as follows:

The degassed coating composition as prepared in above-described step (a) and possibly with the addition of a catalyst in order subsequently to produce cross-linking of the resin is placed in a 'trough' disposed beneath the cylinder to be coated. The cylinder rotates about its axis which is disposed horizontally and 'licks' the surface of the liquid so as to form on the cylinder a fine layer of the coating composition. The trough is then displaced in such a way as to interrupt the licking action and there is then passed over the cylinder a flow of warm air which is intended to facilitate evaporation of the diluent contained in the layer deposited on the cylinder. The temperature of the flow of warm air may be for example about 90° C. when the diluent of the composition is water. The heating operation is then continued until the deposited layer becomes sufficiently viscous for it to be possible to draw a thread therefrom. It often happens that, at this stage in the operation, the resin becomes transparent because the indices of refraction of the filler and the diluted resin reach coincident values. In that case it becomes particularly easy to follow the operation visually.

A second layer of composition and then a third and so forth can possibly be added to the first layer which is deposited in that way by alternating the licking and drying phases, care being taken to ensure that the duration of the licking phase is sufficiently short to produce the deposit of a fresh layer but does not permit dilution of the first layer by the bath of diluted composition. The unitary licking and evaporation operations can be repeated several times in such a way as sufficiently to deposit thin unitary layers to achieve the desired coating thickness. Thus each unitary layer may be from 30 to 100 microns in thickness and the thickness of the final layer may be for example from 100 microns to 1 millimeter.

In an alternative form of the coating step (b), in the case of a steel cylinder of sufficient thickness, it is possible to provide for preheating the cylinder in an oven to 60° to 70° C. and to make use of the stored heat to permit evaporation of the diluent in a flow of air at ambient temperature. At any event it is important for the cylinder to be kept rotating during that drying operation in order to prevent any running of the composition.

In the coating baking step (c), the coated cylinder is generally subjected to a heat treatment in an oven or an autoclave in such a way that the resin, possibly with the addition of a hardener and/or a catalyst, is hardened by cross-linking. The conditions in respect of temperature, pressure and duration of that operation are generally well known to the man skilled in the art but, in the case of the compositions according to the invention which are intended for laser-engravable printing cylinders, it is particularly important to use a temperature-pressure pairing such that the by-products of the polycondensation reaction on the one hand and the diluents or solvents and finally the azeotropes which may be formed in the resin in the course of cross-linking remain in the liquid state dissolved in the resin and do not pass into the condition of boiling to form micro-bubbles within the composition.

Advantageously the baking temperature will be about 10° C. lower than the boiling temperature of the most volatile product present.

The polycondensation reaction generally producing water as a by-product, the baking operation will advantageously be effected at a temperature which is slightly lower than 90° C. if the diluent used is also water and at a temperature which is slightly lower than 65° C. if the diluent used is ethyl alcohol, operating at normal atmospheric pressure. That temperature may be increased by operating in an autoclave.

After deposit and hardening of the coating, the latter is generally subjected to a trueing operation and/or a polishing operation.

By means of the process as described hereinbefore, it is possible to deposit on printing cylinders filled resin coatings having hardness characteristics which are suited to use in direct laser engraving. The resins preferably used to produce those coatings are resols.

Moreover in some cases it may be an attractive proposition to deposit on a coating formed as described above from any resin composition filled with reinforcing particles (such as a filled resol composition), a fine layer of melamine-formaldehyde resin which exhibits highly satisfactory hardness, even without a filler. In such a case the requirement referred to hereinbefore regarding the shape of the filler particles is no longer as imperative as in the above-described cases since they are no longer flush with the surface of the coating. Any roughness is levelled by the layer of melamine-formaldehyde resin which is deposited over the top.

The following example illustrates the invention.

EXAMPLE

This Example used the following:

a resin of resol type, marketed by PERSTORP, in aqueous solution containing 70% by weight of dry extract;

a hardener consisting of a mixture of sulphonic acids in aqueous solution, also marketed by PERSTORP;

a filler formed by particles of silica of the granulometry indicated below:

| size (microns) | >16 | >12 | >10 | >8 | >6 | >4 | >2 | <2 |
|---|---|---|---|---|---|---|---|---|
| accrued % | — | 2.0 | 2.0 | 2.2 | 4.2 | 13.0 | 28.8 | 71.2 |

25 g of resol was mixed with a spatula with 25 g of silica in powder form to give a firm paste which does not lend itself to degassing under vacuum.

To fluidify the mixture, 20 g of demineralized water was added.

The mixture was put under a reduced pressure in a desiccator for a period of a few minutes to remove the included air. A part of the water evaporated during that treatment. A foam of a volume of about ten times the initial volume was first formed, that foam 'broke' in a few seconds, and then the liquid began to boil gently and regularly at ambient temperature.

Once the product was degassed, 1.2 g of hardener (about 5% by weight of the crude resin) was added, all precautions being taken to avoid air being introduced into the mixture, then the product was poured into a trough which was moved into position below the cylinder to be coated, the cylinder being caused to rotate slowly (about 5 revolutions per minute) with a horizontal axis in such a way that the cylinder licks the surface of the product which is deposited thereon in the form of a thin layer for two revolutions. The licking phase is then stopped by moving the trough downwardly and a hot air heating apparatus (Leister) is moved into position, which is regulated at 100° C., to facilitate evaporation of the water of the first layer. After about 5 minutes the mixture which was pink becomes transparent (the index of refraction of the solution becomes equal to that of the filler) while the product is greatly viscous (it is possible to draw a thread therefrom). At that time the flow of hot air is provisionally stopped and the licking operation is begun again for two revolutions to deposit a further layer of fresh product, then the drying operation is resumed until a condition of transparency occurs, and that is repeated three times in succession in order thus to deposit four thin unitary layers and to produce a sufficient coating thickness.

After evaporation of the last layer the whole was enveloped in a sheet of Terphane under slight tension (application by hand) and placed in an oven at 60° C. for a period of 2 hours, the temperature then being raised to 80° C. for a further period of 2 hours. The finished product is of an opaque pink appearance (like a lacquer) and has curly configurations due to non-regularity of the tension of the Terphane.

It is then trued and polished to give a suitable specimen which is directly engravable by laser.

We claim:

1. In a process comprising engraving a coated surface with a laser beam to provide a gravure printing surface, said process comprising impacting said laser beam on zones of said coated surface to engrave them, the improvement wherein said coated surface is formed from a thermally hardened composition consisting essentially of at least one resin, optionally a hardener, and, optionally, a particulate filler, said resin being (a) a condensation polymer consisting essentially of the reaction product of formaldehyde with furfuryl alcohol, furfural, melamine, a phenol or urea, or (b) a furan resin consisting essentially of a reaction product of furfuryl alcohol or furfural with urea, a phenol or itself, said hardened resin, at the zones of laser beam impact, undergoing coking and decomposing to mostly solids or gaseous products at the decomposition temperature.

2. A process according to claim 1, wherein said resin is a melamine-formaldehyde resin or a phenol-formaldehyde resin.

3. A process according to claim 1, said particulate filler being present in the composition and being glass, silica, zirconium oxide, carborundum, alumina or carbon.

4. A process according to claim 3, wherein the particles of the filler have a particle size smaller than 16 microns.

5. A process according to claim 3, wherein said filler is from 5 to 75% of the volume of the sum of the resin and filler.

6. A process according to claim 1, wherein said thermally hardened composition before hardening contained volatile products therein, and said hardening was conducted at a temperature at least 10° C. lower than the boiling point of the most volatile product therein.

7. A process according to claim 1, wherein, prior to engraving, said coated surface is from 100 microns to 1 millimeter in thickness.

8. A process according to claim 1, wherein a layer of unfilled melamine-formaldehyde resin has been previously deposited on the coated surface to be engraved.

9. A process according to claim 1, wherein said thermally hardened composition comprises a baked resin.

10. The process of claim 1, wherein the resin is a furan resin consisting essentially of the reaction product of furfuryl alcohol or furfural with formaldehyde, urea, a phenol or itself.

11. The process of claim 1, wherein the resin is a condensation polymer consisting essentially of the reaction product of formaldehyde with furfuryl alcohol, furfural, melamine or urea.

* * * * *